US006580041B1

(12) United States Patent
Ransopher

(10) Patent No.: US 6,580,041 B1
(45) Date of Patent: Jun. 17, 2003

(54) CIRCUIT BREAKER SAFETY CLIP AND ASSOCIATED METHOD

(75) Inventor: Michael L. Ransopher, Marysville, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 10/041,107

(22) Filed: Jan. 8, 2002

(51) Int. Cl.[7] ..... H01H 27/10

(52) U.S. Cl. ..... 200/43.21; 200/43.11; 200/43.16; 200/43.19

(58) Field of Search ..... 200/43.01, 43.11, 200/43.14–43.16, 43.19, 43.21, 43.22, 50.01, 333, 334, 318, 321

(56) References Cited

U.S. PATENT DOCUMENTS 5,039,829 A * 8/1991 Brucksch ..... 200/43.18
5,147,991 A * 9/1992 Jordan, Sr. ..... 200/43.14
5,207,315 A * 5/1993 Benda ..... 200/43.11
5,412,167 A * 5/1995 Mueller et al. ..... 200/43.14

* cited by examiner

*Primary Examiner*—Michael Friedhofer
(74) *Attorney, Agent, or Firm*—Alston & Bird LLP

(57) ABSTRACT

A circuit breaker safety clip and associated method are provided to identify and secure circuit breakers in an open position. The safety clip securely engages a circuit breaker in an electrical panel such that the circuit breaker must remain in an open position while the safety clip is attached thereto. The size and shape of the safety clip are selected such that the safety clip does not contact, and thus does not damage, other portions of the electrical panel. The safety clip design also provides ease of installation and removal. Additionally, the safety clip may include a warning tag that is durably attached and is appropriately sized to be noticeable without blocking the view of other circuit breakers. Still further, the wrap-around safety clip design of one embodiment protects at least part of the circuit breaker, typically the head of the circuit breaker, from direct impact.

18 Claims, 3 Drawing Sheets

CIRCUIT BREAKER SAFETY CLIP AND ASSOCIATED METHOD

FIELD OF THE INVENTION

This invention relates to a safety clip for identifying and securing a circuit breaker in an open position with the safety clip's size and shape selected such that the safety clip can be easily installed and removed without contacting and damaging the electrical panel housing the circuit breaker.

BACKGROUND OF THE INVENTION

The function of a circuit breaker is to serve as a safety device that either completes an electrical circuit or halts the flow of current through the electrical circuit when open. Moreover, circuit breakers are generally designed to automatically switch from a closed state to an open state, i.e., trip, upon sensing excessive current flowing through the electrical circuit. In most residential and industrial settings, rows of circuit breakers and circuit breaker labels that identify the respective circuit breakers are arranged in electrical panels. The circuit breaker rows may be recessed. In the aircraft industry, for instance, electrical panels may contain rows of lighted plates carrying identification decals positioned alongside recessed rows of circuit breakers to facilitate identification of the circuit breakers, particularly in low light conditions.

Before performing maintenance operations on any electrical system, one typically removes power to the electrical system by opening the circuit breaker associated with the particular system. In the aircraft industry, maintenance personnel must open the circuit breakers for a number of subsystems. For example, the circuit breakers for the primary and secondary flaps, engine ignition, window heat, weather radar, and avionics systems are opened prior to initiating most maintenance operations. Opening the circuit breaker and making sure the circuit breaker remains open until the maintenance is finished is imperative for the safety of the people performing the maintenance on the associated electrical system. In addition, the premature closure of a circuit breaker during maintenance of the associated electrical system may damage or destroy the electrical system itself. Conversely, failing to properly close a circuit breaker following completion of the maintenance operations and prior to flight may create difficulties. An open circuit breaker may cause the aircraft to fail its preflight check or cause problems during flight because the electrical system associated with the circuit breaker is inoperable.

Circuit breaker safety clips are commonly utilized to identify and secure the circuit breakers in the open position and to warn others not to close the circuit breaker so as to apply power to that electrical circuit. The safety clips are attached to at least part of the open circuit breaker so that one cannot close the circuit breaker without removing the safety clip. In this regard, a circuit breaker typically has a handle that is toggled between the opened and closed positions, such as being pushed inward and pulled outward, respectively. The handle, in turn, generally has a stem and a head mounted on the distal end of the stem. As such, circuit breaker safety clips are generally designed to attach to the stem of the circuit breaker handle so as to prevent the handle from moving to the closed position.

The safety clips may also carry a warning tag. For example, in the aircraft industry, a warning tag with the words "REMOVE BEFORE FLIGHT" or the like is affixed to the safety clip. The warning tag reminds maintenance personnel to remove the safety clip and close the circuit breaker following completion of the maintenance so that the respective electrical system is enabled during the preflight check procedure.

For each of the foregoing reasons, the safety of the people performing work on electrical systems and the condition of the electrical systems depend upon the proper installation of circuit breaker safety clips. Likewise, the proper operation of the aircraft following the maintenance depends upon the removal of the safety clip and the closure of the circuit breaker.

At least two types of circuit breaker safety clips are presently available, however, neither is suitable for use in all electrical panels, particularly not in electrical panels with recessed rows of circuit breakers. One type of conventional safety clip has an elongated, rectangular shape with two arms at one end to engage the circuit breaker head and a slit at the opposed end for attaching a warning tag, typically by means of rivets or the like. Unfortunately, the rectangularly shaped safety clip is too large to install and remove without difficulty and without damaging the electrical panel. To use these safety clips in electrical panels with recessed rows of circuit breakers, one must physically force the clip into engagement with a circuit breaker within the electrical panel. Forcing the safety clip into engagement with a circuit breaker within the electrical panel causes scratches and gouges to the electrical panel face, specifically the identification decals located between the rows of circuit breakers. If this damage goes without repair, it may be difficult to identify the circuit breakers because the information imprinted upon the identification decal is scratched off. Alternatively, the identification decals and/or the plate that carries the identification decal may be repaired or replaced, albeit at some cost of time and money. In addition, the size of the warning tag attached to this safety clip is generally quite large. When maintenance personnel use these safety clips, the warning tag may obstruct the view of the rest of the electrical panel and make it difficult to determine the status of the other circuit breakers.

The other type of conventional circuit breaker safety clip has a pair of arms defining a "U" -shape for engaging the circuit breaker head. This conventional circuit breaker safety clip also has a keystone-shaped feature on the side of the clip that is opposite the opening in the clip, which may be grasped to assist in removing the safety clip. This safety clip is not suitable for use in all areas of an electrical panel because the keystone shaped feature may contact the plates located between the rows of circuit breakers and prevent the safety clip from properly engaging the circuit breaker. Furthermore, even in the areas of the electrical panel where this safety clip properly engages at least part of the circuit breaker, it is difficult to remove once it is installed because the safety clip design is too small for some personnel to grasp. A warning tag is also commonly attached to this conventional safety clip with a simple plastic cord. Nevertheless, the lack of a durable attachment for the warning tag to the safety clip increases the possibility that the warning tag will become detached from the safety clip. Without the warning tag, the safety clip may be overlooked during, for instance, a preflight inspection, which would increase the time of the preflight inspection and decrease the efficiency of the ground maintenance operations.

For the reasons described above, some maintenance personnel resist using conventional safety clips. The conventional safety clips may cause damage to the electrical panel, carry inadequate warning tags, and/or be unnecessarily difficult to install or remove. Thus, there is a need for a circuit breaker safety clip designed to properly engage circuit breakers in all the common electrical panels without damaging the panel face, light plates or identification decals. There also exists a need for a circuit breaker safety clip that has a properly sized and durably attached warning tag.

SUMMARY OF THE INVENTION

In accordance with this invention, a safety clip and an associated method are provided to identify and secure circuit breakers in an open position. The size and shape of the safety clip are selected such that the safety clip does not damage electrical panels and provides ease of installation and removal. Additionally, the safety clip may include a warning tag that is durably attached and is appropriately sized to be noticeable without blocking the view of other circuit breakers. Still further, the safety clip may serve to protect at least part of the circuit breaker, typically the circuit breaker head, from direct impact.

According to one embodiment, the cross-section of the safety clip is C-shaped with a first portion defining an opening to receive and engage at least part of the circuit breaker, such as the circuit breaker stem. The safety clip also includes a second portion that is spaced from the first portion and wraps about at least part of the circuit breaker, such as the head of the circuit breaker, so as to protect the circuit breaker from direct impact. The second portion also defines a recess for receiving a warning tag. The safety clip is preferably designed such that this recess opens in the same direction as the opening of the first portion, thereby permitting the safety clip to have the C-shape that serves to protect the circuit breaker and reduce the overall size of the safety clip. The safety clip may also include a third portion that connects the first and second portions and, in some embodiments, defines an aperture for receiving another tag, if necessary.

The first portion of the safety clip defines an opening to receive and engage at least part of the circuit breaker. In one advantageous embodiment, the base of the first portion, i.e., the side of the first portion facing away from the second portion, is shaped to ease the installation and removal of the safety clip and provide clearance between the safety clip and the electrical panel face. This embodiment thereby prevents the damage to the electrical panel that may be caused by conventional safety clips. In this regard, a portion of the base facing the first direction may be angled and, in one embodiment, the opposed portion of the base facing away from the first direction may also be angled.

The recess defined by the second portion of the safety clip is commonly a slit for receiving a portion of a warning tag, which is attached thereto. The side of the second portion that faces the first portion may also be angled to the degree necessary to allow for ease of installation and removal of the safety clip. The shape of this embodiment is such that the safety clip can be installed or removed without the second portion contacting at least part of the circuit breaker.

The safety clip of the present invention can therefore securely engage a circuit breaker in an electrical panel such that the circuit breaker must remain in an open position while the safety clip is attached thereto. As a result of its design, the safety clip will not contact other portions of the electrical panel, such as the identification decals and associated light plates, even as the safety clip is rotated relative to the handle of the circuit breaker, thereby minimizing the possibility of damage to the electrical panel.

The safety clip design also allows for the safety clip to be easily installed and removed. Further, the safety clip permits attaching a warning tag in a durable fashion. The safety clip also permits a warning tag that is sized sufficiently to warn others of the safety clip's presence without unnecessarily covering other portions of the electrical panel. Moreover, the wrap-around safety clip design of one advantageous embodiment not only provides protection by identifying and securing an open circuit breaker, but it also protects at least part of the circuit breaker, typically the head of the circuit breaker, from direct impact.

BRIEF DESCRIPTION OF THE DRAWINGS

Figure 1:
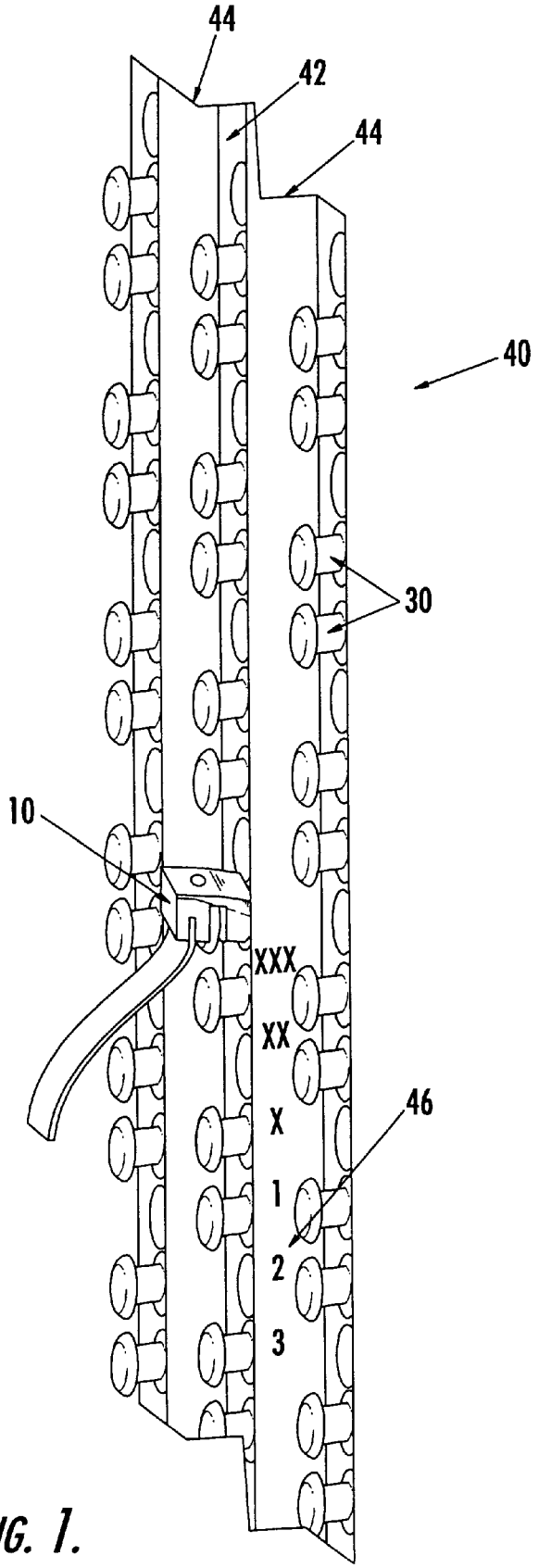
Figure 1A:
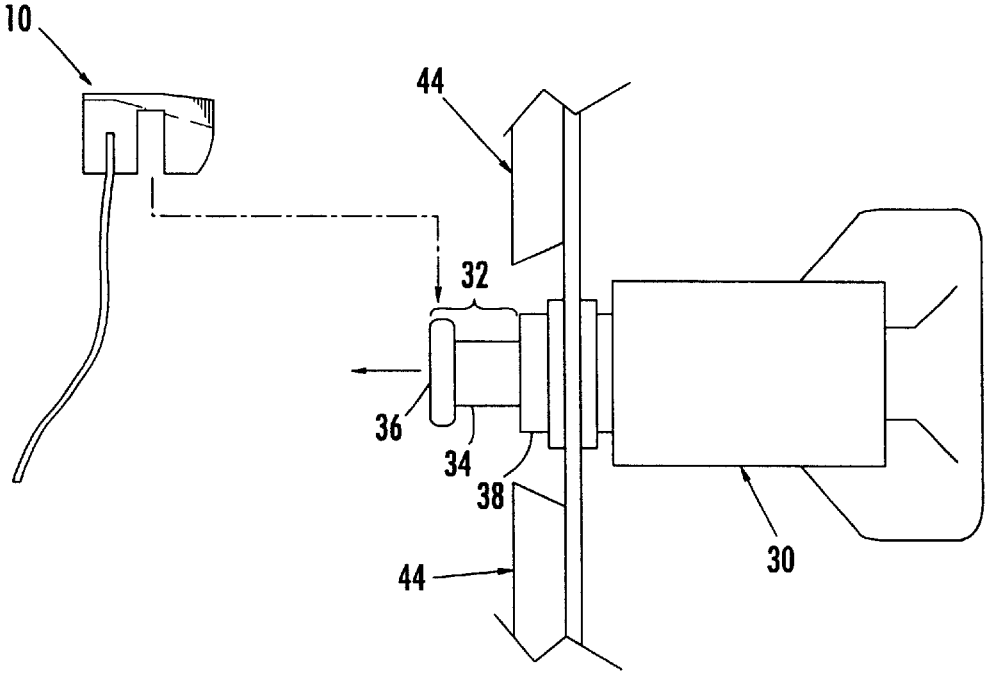
Figure 2:
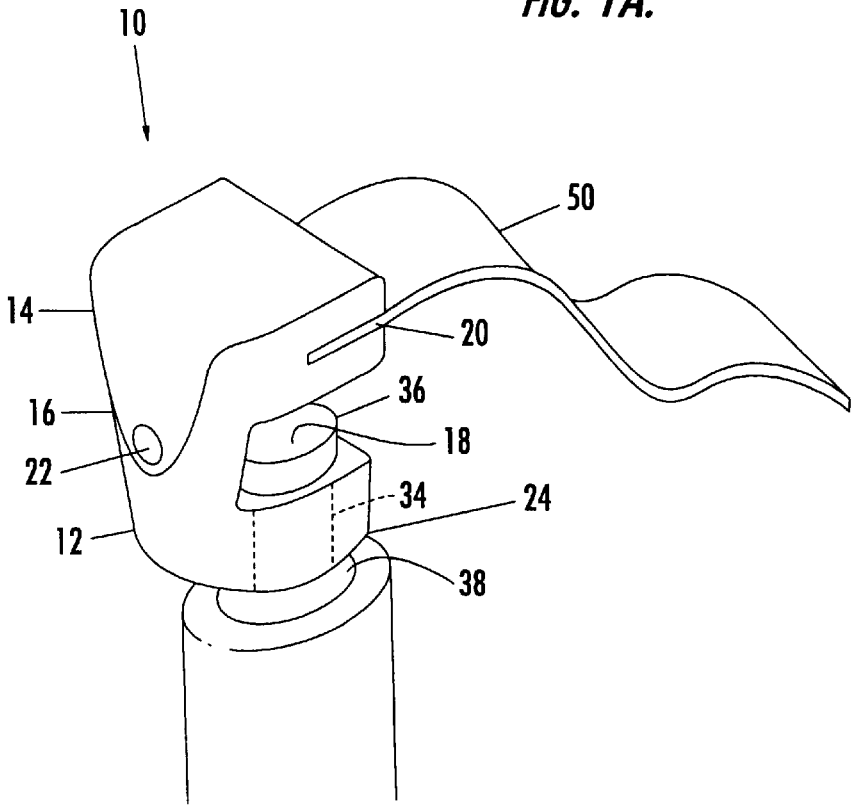
Figure 3:
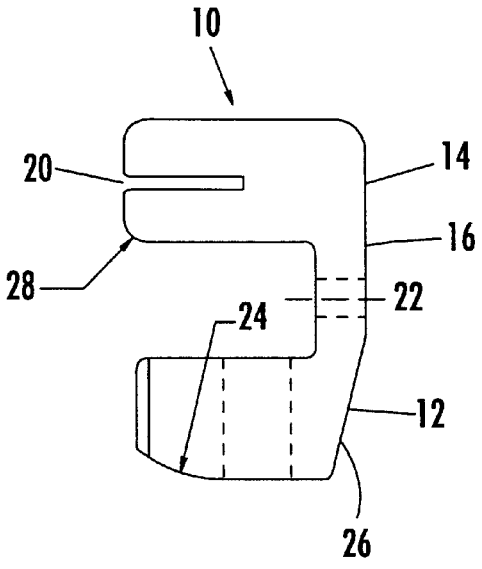
Figure 4:
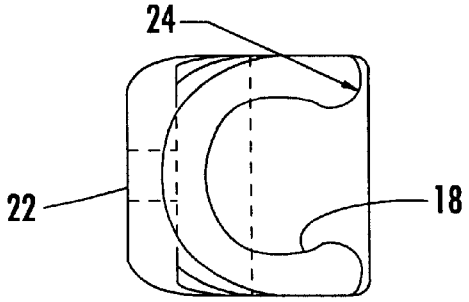
Figure 5:
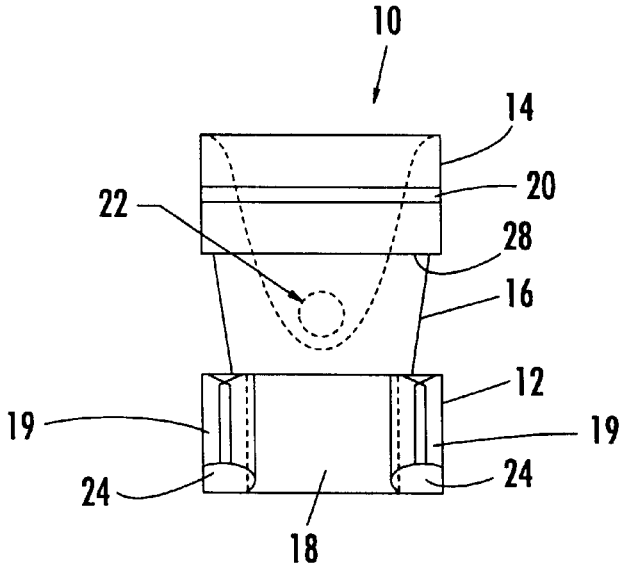

Having thus described the invention in general terms, references will now be made to the accompanying drawings, which are not necessarily drawn to scale, and wherein:

FIG. 1 is a schematic representation of an electrical panel having rows of circuit breakers and corresponding rows of plates with circuit breaker identification decals as well as a circuit breaker safety clip engaging one of the circuit breakers according to one embodiment of the present invention;

FIG. 1A is an enlarged view of a circuit breaker safety clip adapted to engage a circuit breaker according to one embodiment of the present invention;

FIG. 2 is an enlarged view a circuit breaker safety clip engaging a circuit breaker according to one embodiment of the present invention;

FIG. 3 is a cross-sectional view of the circuit breaker safety clip of FIG. 2;

FIG. 4 is an end view of the circuit breaker safety clip of FIGS. 2 and 3; and FIG. 5 is a front view of the circuit breaker safety clip of FIGS. 2–4.

DETAILED DESCRIPTION OF THE INVENTION

The present invention is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

A circuit breaker safety clip 10 according to one embodiment of the present invention is illustrated in FIG. 1. As shown, the safety clip 10 engages a circuit breaker 30, thereby identifying and securing the circuit breaker 30 in the open position. The circuit breaker 30 is typically located within an electrical panel 40. As shown in FIG. 1, the electrical panel 40 commonly contains alternating rows of circuit breakers 42 and circuit breaker labels 46 that identify the respective circuit breakers or the electrical circuits protected by the respective circuit breakers. Typically, the circuit breaker labels 46 are mounted upon plates 44, which, especially in low-light applications, may be lighted. The safety clip 10 of the present invention may be used with a wide variety of pushbutton-type circuit breakers in various applications. For purposes of explanation, but not of limitation, however, the safety clip 10 will be hereinafter described in conjunction with electrical panels that contain a plurality of circuit breakers for protecting electrical subsystems onboard an aircraft.

Circuit breaker 30 is shown in the open position in FIG. 1A, which removes power to the electrical system associated with circuit breaker 30. The circuit breaker handle 32 facilitates opening and closing the circuit breaker 30. While the circuit breaker may have other configurations, the handle 32 of the illustrated embodiment has a stem 34, a head 36 connected to the distal end of the stem 34 to facilitate grasping of the handle 32, and a base 38 from which the stem 34 extends. To close circuit breaker 30 of the illustrated embodiment, the handle 32 is pressed in the direction of the base of the circuit breaker 38. Conversely, to open circuit breaker 30 of the illustrated embodiment, the handle 32 is pulled in the direction opposite of the base of the circuit breaker 38.

As shown in FIG. 2, the circuit breaker clip 10 engages at least part of the open circuit breaker 30, typically the circuit breaker handle 32. Specifically, the safety clip 10 engages the circuit breaker stem 34, such that the safety clip 10 at least partially wraps about the circuit breaker head 36. In this embodiment, the safety clip 10 is positioned about the stem 34 of the circuit breaker handle 32 between the base 38 and the head 36. Engaging the circuit breaker safety clip 10 to the circuit breaker 30 in this way prevents one from applying power to the respective electrical system by closing the circuit breaker 30 without removing the safety clip 10. The safety clip 10 of the present invention is preferably reusable by being snapped on and off different circuit breakers. Nevertheless, the safety clip 10 is preferably designed to securely engage the circuit breaker stem 34 and to only be removed from the circuit breaker stem 34 upon the application of a significant force to the safety clip 10, thereby avoiding any unintentional removal of the safety clip 10.

As also shown in FIG. 2, the circuit breaker safety clip 10 has a first portion 12 defining an opening 18 to receive and engage at least part of the circuit breaker 30, such as the circuit breaker stem 34. As such, the opening 18 preferably has the same shape, such as circular, as the stem 34 and is sized the same or only slightly larger or smaller than the stem 34. The safety clip 10 also includes a second portion 14 that is spaced from the first portion 12 and covers at least part of circuit breaker 30, protecting the circuit breaker 30 from direct impact. As shown, the second portion 14 preferably wraps about the circuit breaker head 36, thereby protecting the circuit breaker head 36 from direct impact. The second portion 14 also defines a recess 20 for receiving a warning tag 50. The safety clip 10 is preferably designed such that the recess 20 opens in the same direction as the opening 18 of the first portion 12, permitting the safety clip 10 to have the C-shape that serves to protect the circuit breaker 30 and reduce the overall size of the safety clip 10. The safety clip 10 may also include a third portion 16 that connects the first portion 12 and the second portion 14. The third portion 16 is preferably designed to space the first portion 12 and second portion 14 by a distance sufficient such that the first portion 12 can engage the circuit breaker stem 34 while the second portion 14 wraps securely about the circuit breaker head 36. The third portion 16 may also define an aperture 22 for receiving another tag, if necessary. The safety clip 10 may be made of any durable, non-conductive material, such as nylon.

FIGS. 3, 4 and 5 further detail the first portion 12 of the safety clip 10. As described above, the opening 18 defined by the first portion 12 is designed to receive and securely engage at least part of the circuit breaker 30. In addition, the first portion 12 is designed to provide spring tension to retain the safety clip 10 on the circuit breaker 30 when the safety clip is installed. In this regard, the first portion 12 generally includes a pair of arms 19 that define the opening 18. The distal ends of the arms 19 of the illustrated embodiment are separated by a distance somewhat less than the diameter of the opening 18. The arms 19, however, are designed to flex outwardly. Thus, the safety clip 10 may be snapped onto the circuit breaker stem 34 with the arms 19 flexing outwardly somewhat to permit the stem 34 to advance between the arms 19 and into the opening 18. Once the stem 34 is seated in the opening 18, the arms 19 return to their nominal position, which effectively retains the stem 34 within the opening 18 until sufficient force is applied to separate the arms 19 and disengage the safety clip 10.

In one advantageous embodiment, the base of the first portion 12, i.e., the side of the first portion 12 facing away from the second portion 14, is shaped to ease the installation and removal of the safety clip 10 and provide clearance between the safety clip 10 and the electrical panel 40. In this regard, a part of the base of the first portion 12 facing the same direction as the opening 18 may be angled. This angled surface of the base of the first portion 12 is depicted in FIGS. 3 and 5 and is represented by the number 24. Likewise, in one embodiment, the opposed portion of the base of the first portion 12 facing away from the direction of the opening 18 may also be angled. This angled surface of the base of the first portion 12 is depicted in FIG. 3 and is represented by the number 26. The degree by which the opposed corners are angled is selected such that the safety clip 10 may be rotated relative to the circuit breaker 30 while continuing to engage the circuit breaker 30 without contacting other portions of the electrical panel 40. Thus, the safety clip 10 of the present invention prevents the damage to the electrical panel 40 that conventional safety clips may cause.

The second portion 14 of the safety clip 10 may also be shaped to easily install and remove the safety clip 10. In one embodiment, the side of the second portion 14 that faces the first portion 12 is angled to adapt the safety clip 10 to easily engage and disengage the circuit breaker 30. The degree by which the side of the second portion 14 that faces the first portion 12 is angled is selected such that the safety clip 10 can be installed and removed without the second portion 14 contacting at least part of the circuit breaker 30. This angled surface is depicted in FIG. 4 and is represented by the number 28.

As described above, the second portion 14 of the safety clip 10 may also define a recess 20 that is commonly a slit for receiving a portion of a warning tag 50. The warning tag 50 may connect to the safety clip 10 in various manners, including by bonding the warning tag 50 in the recess 20 with any type of durable bonding agent or adhesive. The durable bonding agent or adhesive may be injected into the recess 20 and the warning tag 50 may then be inserted into the recess. The warning tag 50 may be made of any durable, bright-colored material, such as nylon material colored fluorescent orange. Any type of wording may appear on the warning tag 50, depending on the application. In the aircraft industry, for instance, the words "REMOVE BEFORE FLIGHT" commonly appear in black lettering on both sides of the warning tag 50. The warning tag 50 also is appropriately sized to be noticeable without blocking the view of other circuit breakers in the electrical panel 40.

FIGS. 2, 3 and 5 also depict an embodiment of the safety clip 10 having a third portion 16. As described above, the third portion 16 may define an aperture 22 for receiving a second tag, if necessary. For example, a second tag that may label the specific components of the system associated with circuit breaker that are undergoing maintenance and the second tag may be connected to the safety clip 10 by means of a plastic cord or the like that extends through the aperture 22. The second tag may be made of any suitable material, such as card stock, and is also generally bright-colored. As such the second tag may be the same or a different color than the first tag 50.

As FIG. 3 illustrates, the cross-section of one embodiment of the safety clip 10 taken through the first portion 12, the second portion 14, and the third portion 16 has a C-shape. As a result of the design of this embodiment, the safety clip 10 will not contact other areas of the electrical panel 40, such as the identification decals 46 carried by respective plates 44. In this regard, the safety clip 10 will not contact other areas of the electrical panel 40 even if the safety clip 10 is rotated relative to the handle of the circuit breaker 32, thereby minimizing the possibility of damage to the electrical panel 40. Accordingly, the identification decals 46 will not be damaged so that maintenance personnel can continue to read the identification decals 46 without difficulty. In addition, the safety clip 10 of the present invention eliminates the time and expense that are otherwise incurred to repair identification decals 46 that are scratched or otherwise damaged.

The C-shaped cross-section of the embodiment of the safety clip 10 in FIG. 3 also illustrates the manner in which the safety clip 10 provides protection for at least part of the circuit breaker 30, typically the head of the circuit breaker 36, from direct impact. In this regard, the second portion 14 of the safety clip 10 wraps about the circuit breaker head 36 so that if the installed safety clip 10 is directly hit, contact will be made with the safety clip 10 and not the circuit breaker 30. As such, the safety clip 10 may prevent damage to the circuit breaker 30 and/or further guard against closure of the circuit breaker 30 because the second portion 14 of the safety clip 10 will absorb the impact and at least partially protect the circuit breaker head 36.

FIGS. 1, 1A and 2 also demonstrate the method of mounting the circuit breaker safety clip 10 of one embodiment upon a circuit breaker 30 in the open position. The circuit breaker safety clip 10 receives and engages at least part of the circuit breaker 30, typically the circuit breaker handle 32. In particular, the opening 18 of the first portion 12 of safety clip 10 of the illustrated embodiment receives and engages the circuit breaker stem 34. In this embodiment, the second portion 14 of the safety clip 10 extends over at least part of the circuit breaker 30, such that the safety clip 10 partially wraps about the circuit breaker head 36. By engaging the circuit breaker 30 with the circuit breaker safety clip 10, the circuit breaker 30 cannot be closed so as to apply power to the respective electrical system without removing the safety clip 10, while also protecting at least part of the circuit breaker 30 from direct impact. Moreover, as described above, the safety clip 10 is designed to accommodate rotation of the safety clip 10 about the circuit breaker handle 32 without scratching or otherwise damaging other portions of the electrical panel 40, including the identification decals 46 carried by plates 44 proximate to the row of circuit breakers 42.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A safety clip for engaging a circuit breaker comprising:

a first portion defining an opening that opens in a first direction for receiving and engaging at least a part of the circuit breaker; and a second portion connected to and spaced from the first portion, the second portion defining a recess that also opens in the first direction for receiving a first tag.

2. The safety clip of claim 1, further comprising a third portion connecting the first portion and the second portion.

3. The safety clip of claim 2, defining an aperture for receiving a second tag.

4. The safety clip of claim 2, having a cross-section taken through the first, second and third portions that has a C-shape.

5. The safety clip of claim 1, wherein the recess is a slit in which a portion of the first tag is bonded.

6. A safety clip for engaging a circuit breaker of an electrical panel comprising:

a first portion defining an opening for receiving and engaging at least a part of the circuit breaker; and a second portion connected to the first portion for receiving a first tag, wherein the safety clip is sized and shaped such that the safety clip is adapted to be rotated relative to the circuit breaker while continuing to engage the circuit breaker without contacting other portions of the electrical panel.

7. The safety clip of claim 6, further comprising a third portion connecting the first portion and the second portion.

8. The safety clip of claim 7, defining an aperture for receiving a second tag.

9. The safety clip of claim 7, having a cross-section taken through the first, second and third portions that has a C-shape.

10. The safety clip of claim 6, wherein the second portion has a recess for receiving the first tag.

11. The safety clip of claim 10, wherein the recess is a slit in which a portion of the first tag is bonded.

12. The safety clip of claim 6, wherein the first portion has a base opposite the second portion, and wherein the portion of the base facing the first direction is angled to adapt the safety clip to be rotated relative to the circuit breaker while continuing to engage the circuit breaker without contacting other portions of the electrical panel.

13. The safety clip of claim 6, wherein the first portion has a base opposite the second portion, and wherein the portion of the base facing opposite the first direction is angled to adapt the safety clip to be rotated relative to the circuit breaker while continuing to engage the circuit breaker without contacting other portions of the electrical panel.

14. The safety clip of claim 6, wherein a side of the second portion facing the first portion is angled to adapt the safety clip to engage and disengage the circuit breaker without the second portion contacting at least part of the circuit breaker.

15. A method of engaging a circuit breaker with a safety clip, which comprises:

providing the safety clip having a first portion defining an opening;

advancing at least a part of the circuit breaker into the opening by causing a pair of arms defining the opening to flex outwardly as at least a part of the circuit breaker is advanced therebetween;

engaging at least a part of the circuit breaker with the safety clip, wherein engaging the circuit breaker comprises receiving at least part of the circuit breaker within the opening defined by the first portion of the safety clip; and protecting at least part of the circuit breaker engaged by the safety clip from direct impact.

16. The method of claim 15, wherein providing the safety clip comprises providing the safety clip having a second portion connected to the first portion, and wherein protecting at least part of the circuit breaker comprises protecting at least part of the circuit breaker with the second portion of the safety clip that extends over a head of the circuit breaker engaged by the safety clip.

17. A method of engaging a circuit breaker with a safety clip, which comprises:

providing the safety clip having a first portion defining an opening;

engaging at least a part of the circuit breaker with the safety clip, wherein engaging the circuit breaker comprises receiving at least part of the circuit breaker within the opening defined by the first portion of the safety clip;

protecting at least part of the circuit breaker engaged by the safety clip from direct impact; and bonding a first tag within a recess defined by the safety clip.

18. A method of engaging a circuit breaker with a safety clip, which comprises:

providing the safety clip having a first portion defining an opening;

engaging at least a part of the circuit breaker with the safety clip, wherein engaging the circuit breaker comprises receiving at least part of the circuit breaker within the opening defined by the first portion of the safety clip;

protecting at least part of the circuit breaker engaged by the safety clip from direct impact; and attaching a second tag by means of an aperture defined by the safety clip.

* * * * *